US006732980B2

(12) United States Patent
Hein

(10) Patent No.: US 6,732,980 B2
(45) Date of Patent: May 11, 2004

(54) RAILWAY FROG WEAR COMPONENT

(75) Inventor: Russell R. Hein, Denison, TX (US)

(73) Assignee: Progress Rail Services Corp., Albertsville, AL (US)

( * ) Notice: Subject to any disclaimer, the term of this patent is extended or adjusted under 35 U.S.C. 154(b) by 0 days.

(21) Appl. No.: 10/266,558

(22) Filed: Oct. 8, 2002

(65) Prior Publication Data

US 2004/0065784 A1 Apr. 8, 2004

(51) Int. Cl.[7] ..... E01B 7/10
(52) U.S. Cl. ..... 246/455; 246/472
(58) Field of Search ..... 246/472, 454, 246/457, 458, 462, 468, 470, 471, 382, 384, 387, 389, 391, 392, 358, 460, 274, 275, 276, 455; 29/527.6, 894.1

(56) References Cited

U.S. PATENT DOCUMENTS 690,336 A * 12/1901 Wharton et al. ..... 246/460
3,755,670 A 8/1973 Damy
5,312,075 A * 5/1994 Kuhn ..... 246/455
5,456,430 A 10/1995 Ortiz-Rivas
5,560,571 A * 10/1996 Remington ..... 246/468
6,266,866 B1 * 7/2001 Ramirez et al. ..... 29/527.6

* cited by examiner

*Primary Examiner*—Frantz F. Jules
(74) *Attorney, Agent, or Firm*—Bracewell & Patterson, L.L.P.

(57) ABSTRACT

A railway frog has a pair of wing rails with converging and diverging portions. A point member is located between forward portions of the wing rails. The forward portion of at least one of the rails has a section adjacent the point that has the rail head removed. A replaceable wear component having a head is located on an upper surface of the web of the wing rail. The wear component has a skirt that bolts to the flange of the wing rail. The wear component is formed of manganese steel.

17 Claims, 5 Drawing Sheets

RAILWAY FROG WEAR COMPONENT

FIELD OF THE INVENTION

This invention relates in general to railway track sections and particularly to frogs, which are junctions where one rail crosses another.

DESCRIPTION OF THE PRIOR ART

A railway frog is employed where one track crosses another. For example, in a turnout, a switch will selectively switch a train from a main track to a turnout track. As the turnout track progresses in a curve from the switch, one of the rails, must cross a rail of the main track. The junction assembly at such crossing is called a frog. If two tracks cross each other, four frogs would be required, one at each intersection of one rail with another.

There are a number of different types of frogs. One type, referred to as a spring frog, has a fixed wing rail and a movable wing rail. The wing rails converge toward each other in a central area of the frog, then diverge from each other. A point member is located between the diverging portion of the wing rails. The point member has point rails on an end opposite the point that are joined to standard rails of the turn out and main track. A spring biases the movable rail against one side of the point member. The flange of a railcar wheel progressing from the main track onto the turnout enters between the movable rail and the point member, spreading them apart from each other. The tread of the wheel passes from the fixed wing rail onto the point. Similarly, when traversing from the turnout back onto the main track, the tread of the railcar wheel moves from the point onto the fixed wing rail.

In both cases, the tread crosses a gap between the point member and the fixed wing rail, this gap being provided for receiving wheel flanges of railcars that are passing through the frog on the main track. The gap increases the contact pressure of the wheel against the point and the fixed wing rail because the tread will not be fully supported on steel as it passes over the gap. This creates repetitive excessive loads on part of the fixed wing rail and point member that cause them to wear more than other portions of the frog. The point member is generally formed of austenitic manganese steel because of its ability to work harden under impact loads and its ability to be repaired by welding. The fixed wing rail of the spring frog can be made of conventional carbon steel as normally used in conventional rails, or the wing portion can be integral to the cast point of austenitic manganese steel. Once the wing portion wears to the point, it is not economical to repair, and the entire casting may be replaced. Replacing an entire casting is a time-consuming and expensive task. A rail made of austenitic manganese steel would be too expensive for the lengthy fixed wing rail.

In a bolted rigid frog, neither of the wing rails are movable. A flangeway is located on each side of the point member. Consequently, a gap must be traversed each time the tread of a railcar wheel passes between the point member and one of the wing rails. The wing rails of bolted rigid frogs are also formed with rails of conventional rail steel. Consequently, they also tend to wear in the areas that are contacted by the railcar wheel adjacent the point.

A railbound frog is rigid with a manganese wing integral to the point. The impact areas can be repaired to a certain point. However, every subsequent repair shortens the casting's life, and replacement is costly.

SUMMARY OF THE INVENTION

The frog of this invention has an impact resistant insert located in at least one of the wing rails adjacent the point of the point member. The insert is preferably formed of austenitic manganese steel, but may be of other materials with similar properties. The insert may be cast, rolled or forged. The wing rail with the insert has a forward section with the head of the rail removed. The forward section has flanges on its lower end for mounting to a frog support. A web extends upward and has an upper edge. The insert has a head that is supported on the upper edge of the web. The insert also has a skirt that extends downward on one side. The skirt is bolted to the web and also preferably to the point member. In one embodiment, a base extends outward from the lower edge of the skirt. The base is bolted separately to the support member.

In the case of a spring frog, one of the inserts is utilized. That insert is located in the forward portion of the rigid wing rail adjacent the point of the point member. In the case of a bolted rigid frog, two of the inserts are utilized. Both inserts are located in the wing rails adjacent the point of the point member.

DETAILED DESCRIPTION OF THE INVENTION

Figure 1A:
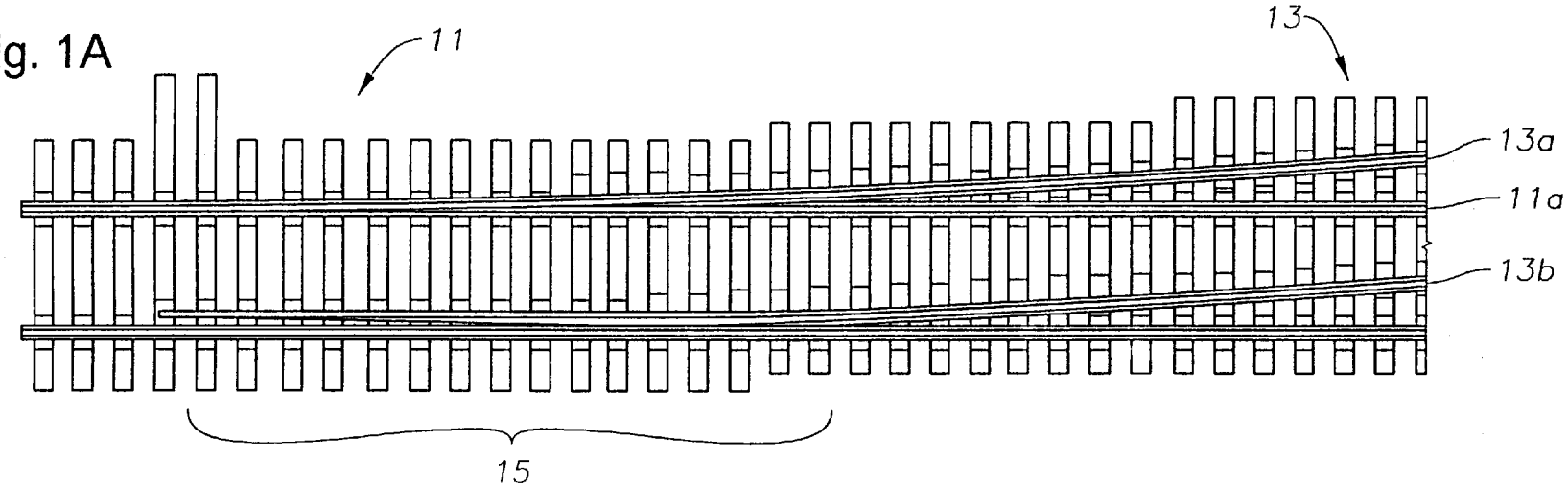
FIGS. 1A and 1B comprise a plan view of a railway turnout having a frog constructed in accordance with this invention.
Figure 1B:
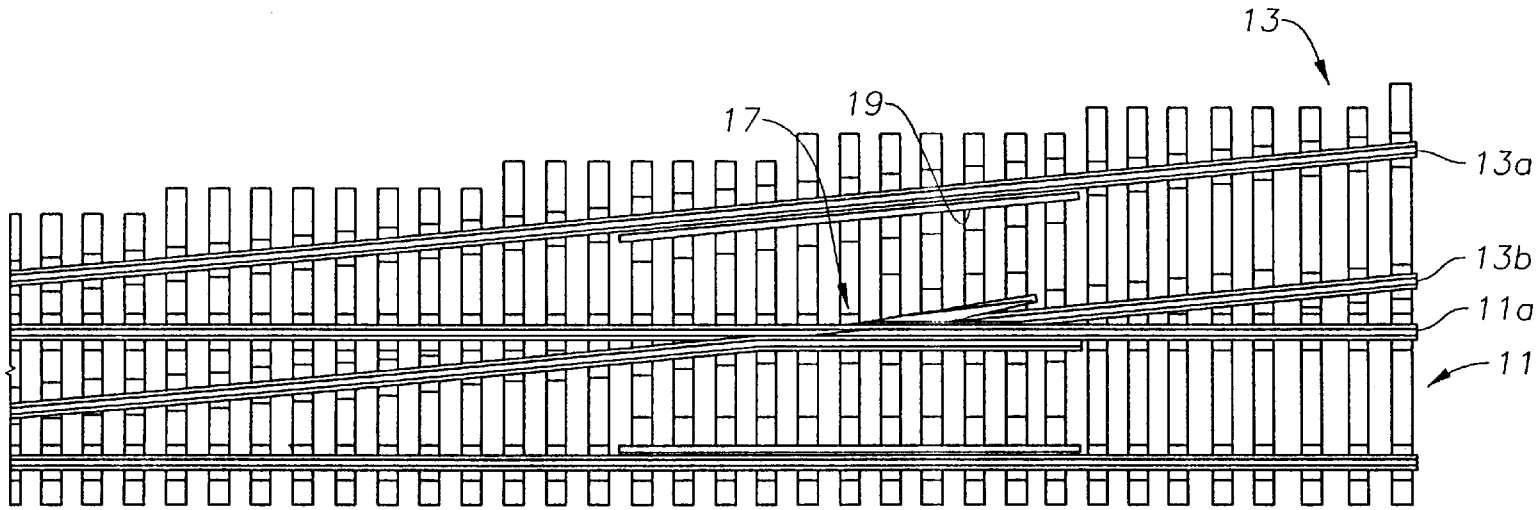

Referring to FIGS. 1A and 1B, a main track 11 and a turnout track 13 are shown. A switching mechanism 15, shown schematically, will selectively switch a path for a train from main track 11 to turnout track 13. Turnout track 13 has one rail, referred to herein as the left-hand rail 13*a*, that is entirely located outside of the rails of main track 11. The right-hand rail 13*b*, however, has to cross the left-hand rail 11*a* of main track 11. A frog 17 is located at the crossing to accommodate this transition. Guardrails 19 are located on opposite sides of frog 17 for retaining the train in the proper lateral position with respect to frog 17. Of course, frogs that turnout in a right-hand direction from a main track, are also utilized.

Figure 2A:
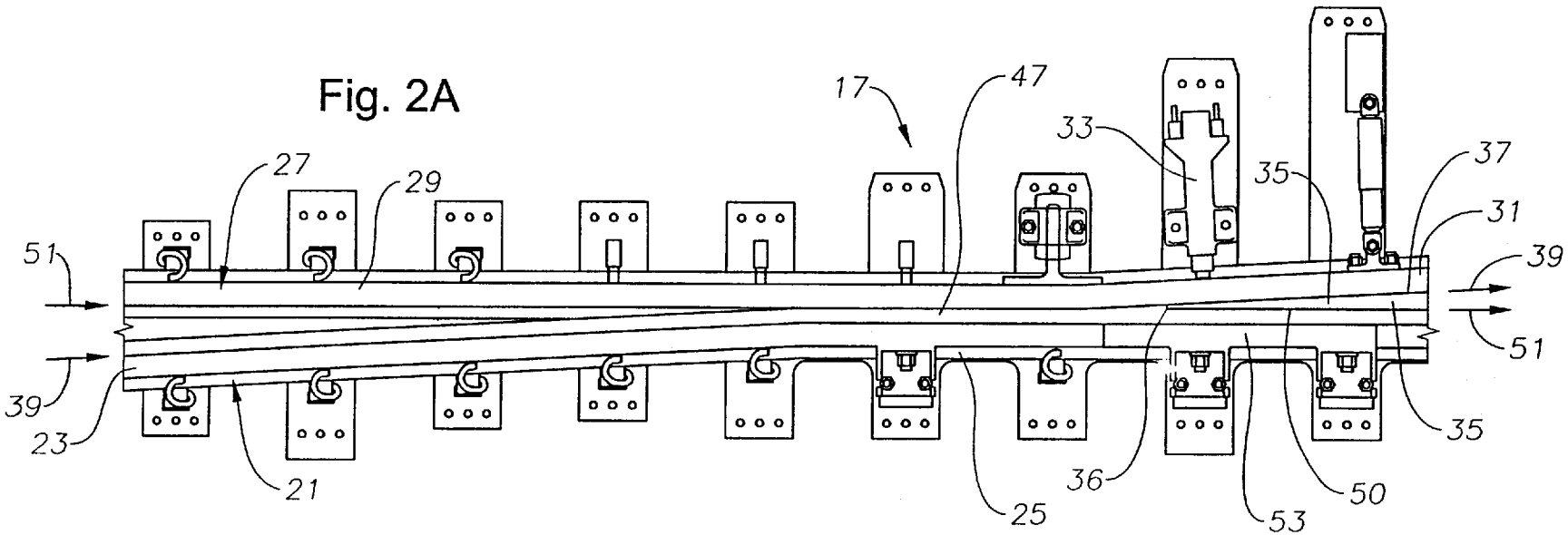
FIGS. 2A and 2B comprise an enlarged plan view of the frog of FIGS. 1A and 1B.

Referring FIG. 2A, frog 17 in this instance comprises a spring frog. Frog 17 has a fixed wing rail 21 that will be joined to right-hand rail 13*b* of turnout track 13 (FIG. 1). For convenience only, the term "forward" is used herein to refer to the direction on turnout tract 13 that is moving away from main track 11, and "rearward" the opposite. Fixed wing rail 21 has a rearward portion 23 and a forward portion 25. Portions 23, 25 are at different angles relative to each other and formed by permanently bending fixed wing rail 21.

A movable wing rail 27, located next to fixed wing rail 21, also has a rearward portion 29 and a forward portion 31. The rearward portions 23, 29 converge towards each other in a forward direction, and the forward portions 25, 31 diverge from each other in a forward direction. Wing rails 21, 27 are generally parallel to each other in the central area between rearward portions 23, 29 and forward portions 25, 31. The forward portion 31 of movable rail 27 aligns or is co-axial with the rearward portion 23 of fixed wing rail 21. Similarly, the forward portion 25 of fixed wing rail 21 is co-axial with rearward portion 29 of movable wing rail 27. Wing rails 21, 27 are formed of conventional rail steel.

The forward portion 31 of movable wing rail 27 is able to flex laterally. A plurality of springs 33 are mounted alongside and perpendicular to movable wing rail forward portion 31 for urging it laterally into a point member 35. Point member 35 is a triangular member formed preferably of an austenitic manganese steel casting although it could be fabricated. In this embodiment, point member 35 has sides that converge to a point 36 on its rearward end. The numeral 37 indicates the interface between movable wing rail 27 and point member 35. Unless a wheel is present, interface 37 is a contact area between movable wing rail 27 and point member 35. When a railcar wheel flange engages interface 37, interface 37 separates because the flange of the railcar wheel will force movable wing rail forward portion 31 laterally away from point member 35. The arrows 39 indicate the path of a flange of a railcar wheel that is moving in a forward direction from fixed wing rail rearward portion 23 onto point member 35. This is the path that is taken by the right-hand wheels when a railcar moves from the main track 11 onto the left-hand turnout track 13 (FIGS. 1A and 1B).

Figure 2B:
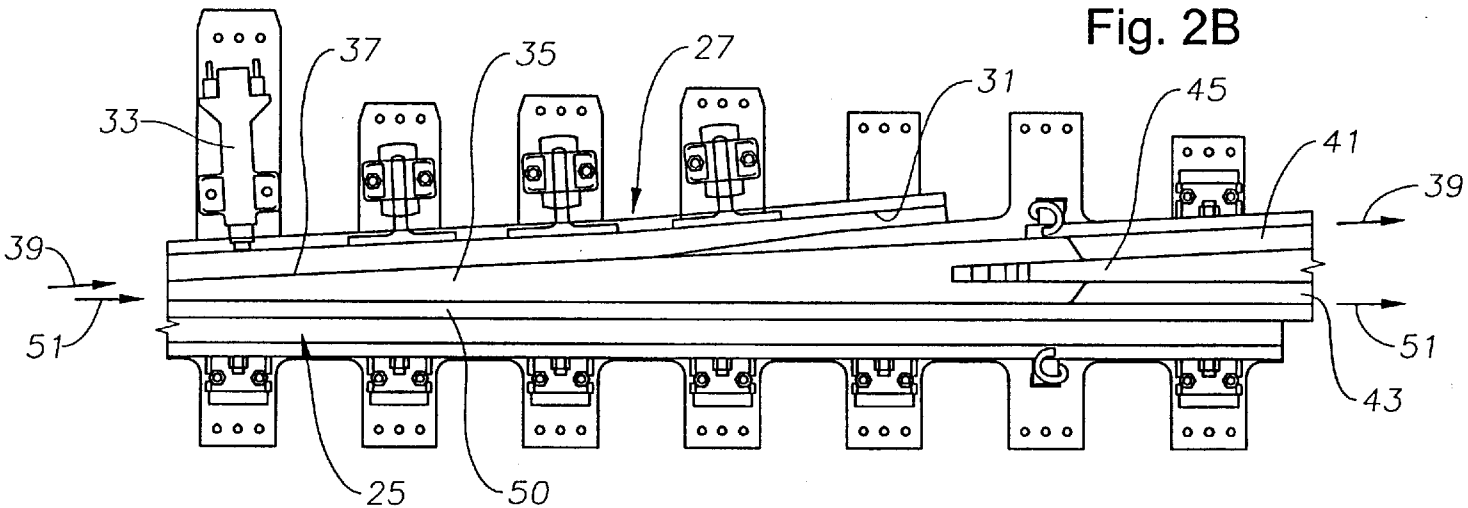

Referring to FIG. 2B, point member 35 includes two diverging point rails 41, 43 at its forward end opposite point 36. Point rails 41, 43, which are spaced apart from each other by a gap or cavity 45, are shown fixed or bolted to point member 35. Point rail 41 joins a conventional right-hand rail 13*b* of turnout track 13 (FIG. 1B), while point rail 43 joins a conventional left-hand rail 11*a* of main track 11. A flangeway 47 (FIG. 2A), which is an elongated recess, is formed between movable wing rail 27 and fixed wing rail 21 in the central area where they are substantially parallel to each other. Flangeway 47 accommodates the flanges of railcar wheels traversing frog 17 on turnout track 13. A flangeway 50 (FIG. 2B) is formed between point member 35 and the forward portion 25 of fixed wing rail 21 to accommodate the flanges of railcar wheels traversing frog 17 on main track 11(FIG. 1B). In FIGS. 2A and 2B, arrows 51 indicate the pathway of a railcar wheel flange on main rail 11*a* (FIG. 1B), and arrows 39 indicate the pathway of a wheel flange of a railcar on turnout rail 13*b* (FIG. 1B).

Figure 3:
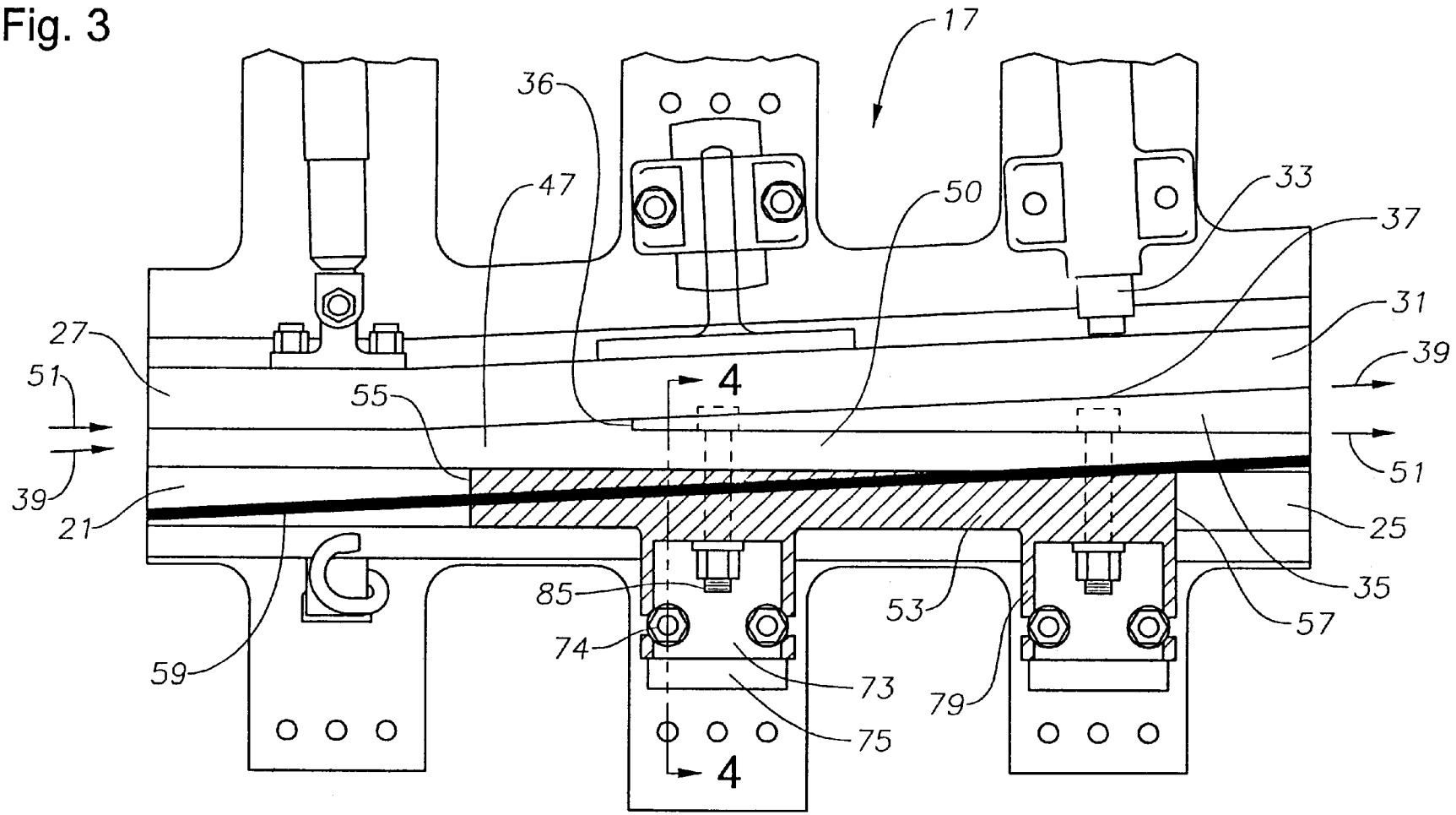
FIG. 3 is a further enlarged plan view of a portion of the frog of FIGS. 1A and 1B, showing an insert in accordance with this invention.

An insert or wear component 53 is located adjacent point member 35 on fixed wing rail forward portion 25. As shown in FIG. 3, insert 53 has a rearward end 55 that extends rearward past point 36 a short distance into the central area between the converging and diverging portions of the wing rails 21, 27. Insert 53 has a forward end 57 that extends in a forward direction past point 36 a selected distance. The length of insert 53 is preferably in the range from two feet to four feet, but it could be longer or shorter in certain frogs. The cross-hatchings in FIG. 3 are used to differentiate insert 53 from the other components of frog 17, and not to indicate a cross-sectional view. The dark line 59 indicates a path for the tread of a railcar wheel that is moving from fixed wing rail forward portion 25 onto point member 35 or vice versa. The actual width of the tread will be greater than the width of line 59; the tread will extend approximately from line 59 to arrow 39, which indicates the pathway for the flange.

Flangeways 47 and 50 are recesses, consequently, the tread will not be fully supported over flangeways 47, 50 as it rolls between point member 35 and forward portion 25 of fixed wing rail 21. The lack of support increases the contact stress, causing wear. Insert 53 is positioned to be contacted by the treads of railcar wheels as they traverse the gaps created by flangeways 47 and 50. Insert 53 is preferably a casting of austenitic manganese steel as mentioned above, but can be cast, forged or fabricated from a variety of materials. Insert 53 is secured to fixed wing rail 21 so that it can be readily removed for repair or replacement.

Figure 4:
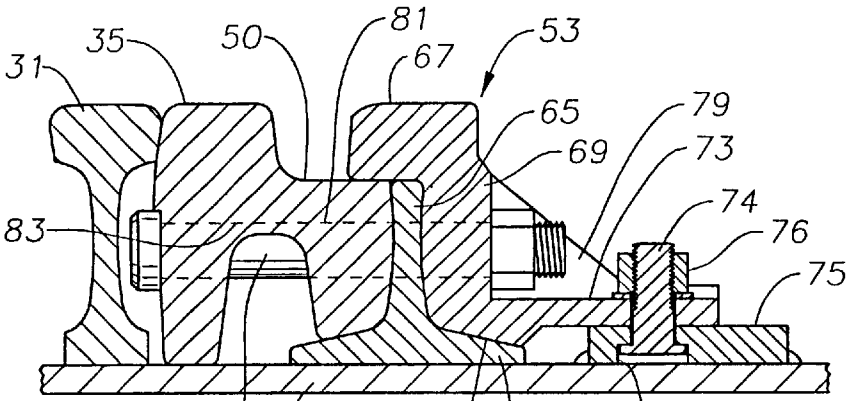
FIG. 4 is a sectional view of the frog as shown in FIG. 3, taken along the line 4—4 of FIG. 3.

Referring to FIG. 4, fixed wing rail 21 has conventional flanges 61 that are supported by surface 63 of frog 17. The portion of fixed wing rail 21 under insert 53 has an upward protruding web 65 that has an upper edge that is horizontal and parallel to support surface 63. The conventional head on fixed wing rail 21 for supporting a railcar wheel has been cut off of the upper end of web 65 in the vicinity of point 36. Insert 53 has a head 67 that overlies the upper edge of web 65, head 67 being sized to conventional rail head widths for receiving the tread of railcars. A skirt 69 extends downward from head 67 in contact outer side of web 65. Skirt 69 also has a lower end 71 that is tapered for mating engagement with the upper side of one of the flanges 61. Load is thus transferred from head 67 through web 65, and also from head 67 down skirt 69 into flange 61.

In this embodiment, insert 53 also has a base 73 that extends laterally outward from the lower end of skirt 69. Base 73 is horizontal plate that receives a pair of fasteners 74, shown also in FIG. 3. Fasteners 74 extend upward through a riser 75 that is welded to frog support surface 63. The head of fastener 74 is located within a counterbore 77 on the lower side of riser 75. This allows one to release base 73 by unscrewing nuts 76 from fastener 74. The bracing provided by base 73 also includes a pair of vertical gussets 79 that extend from each edge of base 73 to skirt 69. Base 73 may also be secured by the use of a threadless fastener such as a spring clip that performs the function of fasteners 74 and 76.

In the preferred embodiment, point member 35 has an integral filler portion 81 that extends laterally over into contact with web 65 and flange 61 on the side opposite skirt 69. Filler portion 81 may alternately be a separate member from point member 35. Filler portion 81 has an upper surface that defines flangeway 50. A plurality of horizontal holes 83 extend through point member 35, web 65 and skirt 69 for receiving bolts 85. Bolts 85 secure insert 53 to point member 35 and web 65. A portion of head 67 overlies and contacts an upper surface of filler portion 81.

In the operation of the first embodiment, a railcar progressing from main track 11 onto turnout 13 (FIGS. 1A and 1B) has right-hand wheels that pass on rail 13*b* over frog 17. Referring to FIG. 2, arrows 39 show the path of the wheel flange, which is on the left side of fixed wing rail 21. The tread of the right-hand railcar wheel first engages the head of fixed wing rail 21. As indicated by arrow 39, the flange of the wheel will pass through flangeway 47 and into interface 37 between the forward portion 31 of movable wing rail 27 and point member 35. The guard rails 19 (FIG. 1B) cause the wheel flange to force movable wing rail forward portion 31 outward to define a flangeway. The tread of the wheel is supported first by the head of fixed wing rail 21, then head 67 of insert 53, then point member 35 and point rail 41. The car could move from the opposite direction, with the reverse applying.

Arrows 51 indicate a path of a railcar moving along main track 11. The tread of the left-hand wheels of that railcar will pass from the head of movable wing rail 27 onto point member 35 and point rail 43. The flange passes through flangeway 50 between point member 35 and the forward portion 25 of fixed wing rail 21.

Figure 6:
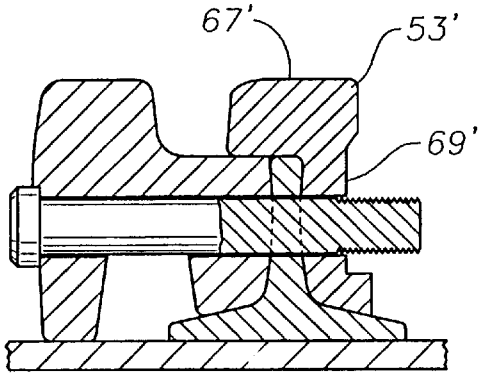
FIG. 6 is a sectional view of the insert of FIG. 5, taken along the line 6—6 of FIG. 5.
Figure 5:
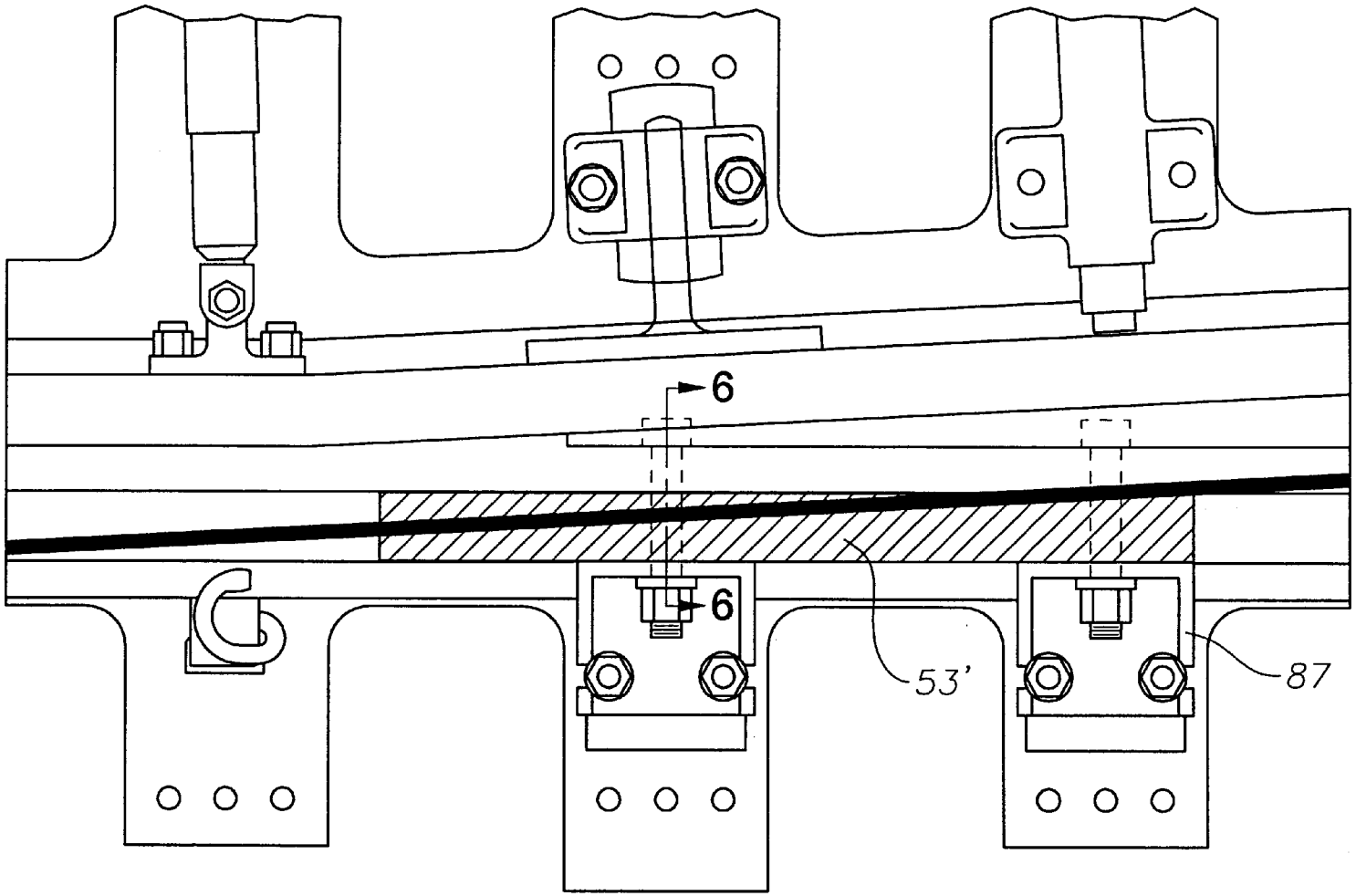
FIG. 5 is a plain view similar to FIG. 3, but showing an alternate embodiment of an insert.

FIGS. 5 and 6 illustrate an alternate embodiment. It differs in that it does not have an integrally formed base 73, such as shown in FIG. 2A. Insert 53' has a head 67' and a skirt 69' as in the other embodiment. As shown in FIG. 6, separate bracing 87 could be mounted to the outer side of skirt 69'. Bracing 87 could be configured similar to base 73 and gussets 79 of the first embodiment.

Figure 7:
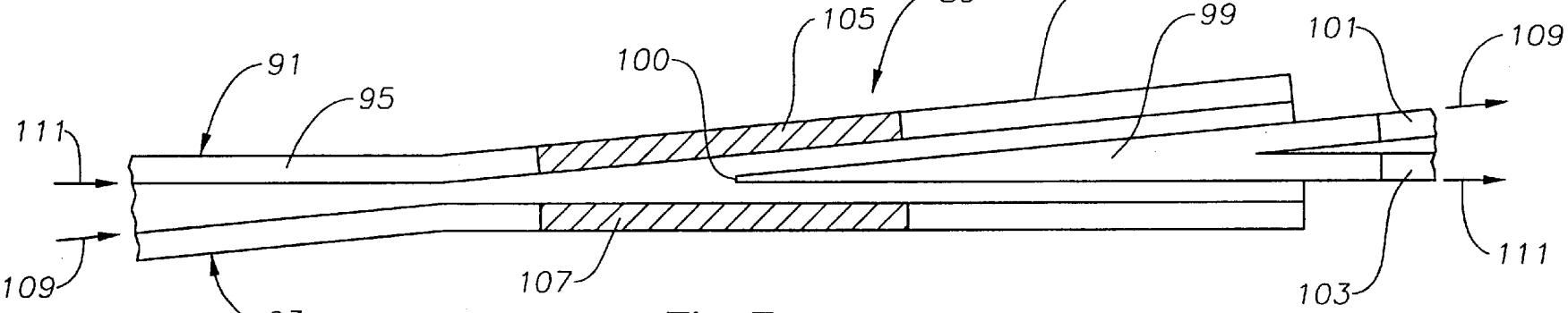
FIG. 7 is a plan view illustrating a bolted rigid frog having inserts in accordance with this invention.

FIG. 7 illustrates a fixed bolted rigid frog 89 in accordance with this invention. Rigid frog 89 does not have a movable rail. Rather, it has fixed wing rails 91, 93 that converge in a forward direction as in the other embodiment. Each has a rearward portion 95 and a forward portion 97. Forward portions 97 diverge from each other in a forward direction. A point member 99 is located between the forward portions 97 of wing rails 91, 93. Point member 99 has a point 100 on one end and two point rails 101, 103 on the opposite end. Point member 99 could be fabricated from the two point rails 101, 103 or it could be a casting.

An insert 105 is located in wing rail 91 adjacent point 100. Similarly, an insert 107 is located in wing rail 93 adjacent point 100. Inserts 105, 107 may be formed of austenitic manganese steel, or may be cast, forged or fabricated from a variety of materials. Inserts 105, 107 are constructed generally as shown in the other embodiment, each having a head portion, a skirt portion and an optional base portion. The arrows 109 indicate the flange path for a railcar wheel on the right-hand rail 13*b* (FIG. 1B) of a turnout section. Arrows 111 indicate a flange path for railcar wheels on the left-hand main track rail 11*a*. As in the other embodiments, the flanges of the railcar wheels, whether on main track 11 or turnout track 13, are located between the two wing rails 91, 93.

The invention has significant advantages. The insert is placed in a position of a spring or rigid bolted frog that normally encounters severe wear. The inserts easily bolt in place and are removable for repair or replacement. The insert is preferably of manganese steel for increased wear resistance and repairability.

While the invention has been shown in only three of its forms, it should be apparent to those skilled in the art that it is not so limited thus susceptible to various changes without departing from the scope of the invention.

I claim:

1. A railway frog, comprising:

first and second wing rails having rearward portions converging toward each other and forward portions diverging from each other;

first and second point rails joining each other and aligned with the rearward portions of the first and second wing rails, respectively, the first and second point rails defining a point member located between the forward portions of the first and second wing rails;

the forward portion of the second wing rail having a section with a pair of flanges and a web protruding upward therefrom;

a wear insert mounted on the forward portion of the second wing rail adjacent the point member, the wear insert having a head for rolling contact with a tread of a wheel of a railcar, the head mounted on an upper edge of the web, the wear insert having a depending skirt that extends alongside the web;

at least one fastener extending through the skirt and the web; and wherein the point member has a filler portion that is secured to the web of the forward portion of the second wing rail opposite the skirt, and wherein the head of the wear insert overlies part of the filler portion.

2. The frog according to claim 1, wherein the wear insert is formed of a manganese steel.

3. The frog according to claim 1, wherein the forward portion of the first wing rail comprises a spring wing rail biased against a side of the point member.

4. The frog according to claim 1, wherein the forward portion of the first wing rail has a pair of flanges and a web protruding upward therefore; and a second insert is mounted on the forward portion of the first wing rail.

5. The frog according to claim 1, wherein the insert has a rearward portion extending rearward past a point of the point member and a forward portion extending forward past the point.

6. The frog according to claim 1, wherein the forward portion of the second wing rail is stationary and the forward portion of the first wing rail is laterally movable and biased into contact with the point member.

7. The frog according to claim 1, further comprising a base extending horizontally from the skirt of the insert, the base adapted to be secured to a supporting surface of the frog.

8. In a frog, having a pair of wing rails that have rearward portions that converge toward each other in a forward direction and forward portions that diverge from each other, a pair of point rails that converge to a point member in a rearward direction that extends between the forward portions of the wing rails, the improvement comprising:

the forward portion of at least one of the wing rails having a section adjacent a point of the point member with flanges adapted to be mounted to a frog support surface and a web protruding upward therefrom, the web having an upper edge;

at least one replaceable insert of a different material than the wing rails, the insert having a head with a lower surface that contacts and overlies the upper edge of the web, the head adapted to be engaged by a tread of a wheel of a railcar, the insert having a skirt that depends from the head and extends alongside and in contact with the web, the skirt having a lower end that contacts an upper side of one of the flanges;

a plurality of bolts for fastening the skirt to the web; and wherein the insert further comprises a base extending horizontally from a lower edge of the skirt, and at least one fastener for securing the base to the frog support surface.

9. The frog according to claim 8, wherein the insert is formed of manganese steel.

10. The frog according to claim 8, wherein the forward portion of one of the wing rails is laterally movable and biased into contact with the point member.

11. The frog according to claim 8, wherein the frog is a bolted rigid assembly, and the forward portion of both of the wing rails has one of the inserts mounted thereon.

12. The frog according to claim 8, wherein the insert has a rearward portion extending rearward past the point of the point member and a forward portion extending forward past the point.

13. The frog according to claim 8, wherein a flangeway is located between the point member and the forward portion of one of the wing rails.

14. In a frog, having a pair of wing rails that have rearward portions that converge toward each other in a forward direction and forward portions that diverse from each other, a pair of point rails that converge to a point member in a rearward direction that extends between the forward portions of the wing rails, the improvement comprising:

the forward portion of at least one of the wing rails having a section adjacent a point of the point member with flanges adapted to be mounted to a frog support surface and a web protruding upward therefrom, the web having an upper edge;

at least one replaceable insert of a different material than the wing rails, the insert having a head with a lower surface that contacts and overlies the upper edge of the web, the head adapted to be engaged by a tread of a wheel of a railcar, the insert having a skirt that depends from the head and extends alongside and in contact with the web, the skirt having a lower end that contacts an upper side of one of the flanges;

a plurality of bolts for fastening the skirt to the web; and a filler in contact with the web of the forward portion of the first wing rail, the filler being located on an opposite side of the web from the skirt; and wherein the head of the insert overlies part of the filler.

15. A spring frog, comprising:

a fixed wing rail having a rearward portion and a forward potion;

a movable wing rail having a rearward portion that converges in a forward direction with the rearward portion of the fixed wing rail, and a forward portion that diverges from the forward portion of the fixed wing rail in a forward direction;

a point member located between the forward portions of the movable and fixed wing rails, defining a flangeway between the forward portion of the fixed wing rail and the point member;

a spring that biases the forward portion of the movable wing rail into lateral contact with the point member on a side opposite the flangeway;

a replaceable wear insert formed of manganese steel that is mounted in the forward portion of the fixed wing rail adjacent a point of the point member for contact with a tread of a railcar that is moving between the forward portion of the fixed wing rail and the point member;

a section of the forward portion of the fixed wing rail having a pair of flanges on its lower end that are adapted to mount on a frog support surface, and a web that protrudes upward therefrom and has an upper edge;

the wear insert having a head with a lower side that overlies the upper edge of the web, and a skirt extending downward from the head on a side of the fixed wing rail opposite the point member into contact with an upper surface of one of the flanges;

a plurality of bolts extending through the skirt and web to fasten the insert to the web; and wherein the insert further comprises a base extending horizontally from a lower edge of the skirt, and at least one fastener for securing the base to the frog support surface.

16. The frog according to claim 15, wherein the insert has a rearward portion extending rearward past the point and a forward portion extending forward past the point.

17. A rigid bolted frog, comprising:

a pair of wing rails having rearward portions that converge toward each other in a forward direction, and forward portions that diverge from each other in a forward direction;

a point member having a point located between the forward portions of the wing rails;

each of the forward portions of the wing rails having a section adjacent the point that has a pair of flanges and an upward protruding web, the web having an upper edge;

a pair of manganese steel wear inserts, each having a head that is supported on the upper edge, a skirt that depends from the head and is secured by fasteners to the web, the heads of the inserts adapted to be contacted by a tread of a railcar wheel when traversing between the point member and the forward portion of one of the wing rails and wherein the insert further comprises a base extending horizontally from a lower edge of the skirt, and at least one fastener for securing the base to the frog support surface.

* * * * *